United States Patent [19]

Willi

[11] Patent Number: 4,696,465

[45] Date of Patent: Sep. 29, 1987

[54] METHOD AND DEVICE FOR ALIGNING SHEETS

[75] Inventor: Jeschke Willi, Heidelberg, Fed. Rep. of Germany

[73] Assignee: Heidelberger Druckmaschinen AG, Heidelberg, Fed. Rep. of Germany

[21] Appl. No.: 798,821

[22] Filed: Nov. 18, 1985

[30] Foreign Application Priority Data

Nov. 17, 1984 [DE] Fed. Rep. of Germany ..... 3442135

[51] Int. Cl.[4] ..... B65H 9/06

[52] U.S. Cl. ..... 271/237; 271/238; 271/240; 271/243; 271/250; 271/270

[58] Field of Search ..... 271/230, 231, 237, 243, 271/244, 250, 195, 270, 240, 236, 238, 243, 251

[56] References Cited

U.S. PATENT DOCUMENTS

| | | | |
|---|---|---|---|
| 1,947,211 | 2/1934 | McFarlane | 271/243 X |
| 2,406,006 | 8/1946 | Eckhard | 271/243 X |
| 2,979,331 | 4/1961 | Backhouse | 271/243 X |
| 2,984,483 | 5/1961 | Kist | 271/237 |
| 3,388,905 | 6/1968 | Nash | 271/237 |
| 3,624,807 | 11/1971 | Schwebel | 271/236 |
| 3,791,642 | 2/1974 | Schunemann | 271/236 |
| 3,918,706 | 11/1975 | Craft | 271/195 |
| 3,942,787 | 3/1976 | Bolza-Schünemann | 271/237 |
| 4,090,704 | 5/1978 | Smith | 271/195 |
| 4,588,184 | 5/1986 | Jeschke | 271/237 |

FOREIGN PATENT DOCUMENTS

| | | | |
|---|---|---|---|
| 2720599 | 11/1978 | Fed. Rep. of Germany | 271/237 |
| 405366 | 7/1966 | Switzerland | 271/237 |
| 580531 | 10/1976 | Switzerland | 271/243 |

*Primary Examiner*—Richard A. Schacher

*Attorney, Agent, or Firm*—Herbert L. Lerner; Laurence A. Greenberg

[57] ABSTRACT

A method of aligning sheets during stream feeding of a multiplicity of sheets over a feed table to a first steadily rotating cylinder of a sheet-processing medium includes in a first feeding stage, conveying the sheets in an imbricated arrangement thereof via the feed table and in a given direction to an alignment region; in a second feeding stage, aligning a lateral and a leading edge of the sheets in the alignment region while the sheets remain in the imbricated arrangement thereof and without interrupting movement of the sheets in the given direction and, in a third feeding stage, accelerating the speed at which the sheets are stream fed to a peripheral speed of a rotating cylinder and feeding the sheets to the first steadily rotating cylinder, while finally aligning the sheets at front markers.

21 Claims, 8 Drawing Figures

METHOD AND DEVICE FOR ALIGNING SHEETS

The invention relates to a method and device for aligning sheets during stream feeding of a multiplicity of sheets over a feed table to a first uniformly or steadily rotating cylinder of a sheet-processing machine.

Through German Published Prosecuted Application (DE-AS) No. 1 210 900, a stream feeding system for sheets is already known. This is a sheet feeder for printing and sheet processing machine with independently controllable sheet conveying elements which grip the sheet on both sides of the middle thereof. The control of the sheet conveying elements is provided by light barriers of which at least two, respectively, are consecutively arranged in the conveying direction. The control pulses of these sensor elements formed as light barriers vary the conveying speed of the respectively associated sheet conveying element with the aid of a differentiating circuit so that the leading edge of the sheet approaches the transfer point parallel to the gripper system and with synchronous speed, and the sheets are transferred without any necessity for stopping the machine beforehand. Lateral alignment of the sheet takes place simultaneously while it is conveyed to the transfer point of the machine by means of a diagonal drive with the aid of lateral control markers.

The imbricated or overlapping sheets transferred from the stack to the table should be drawn apart at this point due to increasing the speed so that they pass over the table in individual sequence. A relatively long feed table is necessary for this purpose. In addition, the reliability of the sheet alignment system by simply varying the conveying speed leaves much to be desired. The speed at the feed table is much too high to be effectively used for modern high-speed machines.

European Pat. No. 0 120 348 A 2 discloses a device for stream feeding sheets which is provided beneath the feed table with an alignment cylinder to which the sheet to be aligned is directed over the feed table, at least two rows of front markers and side edge alignment devices associated therewith being provided in the alignment cylinder symmetrically at the periphery thereof and, furthermore, gripping elements being arranged in the alignment cylinder which hold the sheet until other further conveying transport elements take over the sheet.

Reliable alignment of the sheets in conjunction with careful handling of the sheet edges in indeed possible with this device, however, this good result must be paid for at relatively great expense.

It is accordingly an object of the invention to provide a simple, inexpensively priced yet reliable alignment method and device for stream fed sheets at high printing speeds.

With the foregoing and other objects in view, there is provided, in accordance with the invention, a method of aligning sheets during stream feeding of a multiplicity of sheets over a feed table to a first steadily rotating cylinder of a sheet-processing machine, which comprises in a first feeding stage, conveying the sheets in an imbricated arrangement thereof via the feed table and in a given direction to an alignment region; in a second feeding stage, aligning a lateral and a leading edge of the sheets in the alignment region while the sheets remain in the imbricated arrangement thereof and without interrupting movement of the sheets in the given direction and, in a third feeding stage, accelerating the speed at which the sheets are stream fed to a peripheral speed of a rotating cylinder and feeding the sheets to the first steadily rotating cylinder, while finally aligning the sheets at front markers.

In accordance with an additional aspect of the invention, there is provided a method which includes a device for aligning sheets during stream feeding of a multiplicity of sheets over a feed table to a first steadily rotating cylinder of a sheet-processing machine, comprising a conveyor system disposed in an upper region of a feed table for conveying the sheets in an imbricated arrangement thereof and in a given direction to an alignment region; the alignment region together with a diagonal drive, side markers and preliminary leading-edge alignment markers which revolve in the given direction being connected with the conveyor system on the feed table; an acceleration device cooperating with the diagonal drive for accelerating the conveying speed of the sheets to a peripheral speed of an impression cylinder; and front markers disposed on at least one conveying device following the diagonal drive.

In the case of a continuous stream sheet conveying system, alignment and preliminary alignment, respectively, of the conveyed sheet is effected by means of moved and fixed stops. This ensures that the sheet will be guided reliably and that correct positioning will be achieved. Because, for example, the conveying speed in the alignment area of the sheets is one fourth of the peripheral speed of the printing cylinder, the acceleration of heavy sheets, even cardboard, up to the peripheral speed of the impression cylinder is possible even at high printing speeds well above 10,000 impressions per hour.

In accordance with another feature of the invention, there are provided sheet-guiding drive elements located in the alignment region and revolving in the conveying direction of the sheets, the drive elements having a speed which is at most equal to the stream feeding speed of the imbricated sheets, the preliminary leading-edge alignment markers being disposed on the drive elements, blowing suction nozzles disposed in the alignment region in the feed table for holding the sheets and for placing them, respectively, in engagement with the preliminary leading-edge alignment markers as well as a side marker rail, the acceleration device comprising suction rollers for taking up the sheets and accelerating the conveying speed thereof to the peripheral speed of the impression cylinder, and the one conveying device following the diagonal drive comprising the first steadily rotating cylinder and carrying the front markers. In accordance with an additional feature of the invention, the acceleration device comprises preliminary grippers to which the front markers are attached.

In accordance with a further feature of the invention, the preliminary grippers, as viewed in conveying direction of the sheets, are arranged offset with respect to rear reversing rollers for the drive elements, and including conveyor rollers disposed coaxially with the rear reversing rollers and rotatable at the same speed thereof.

In accordance with yet another feature of the invention, the conveyor rollers are in the form of suction wheels.

In accordance with yet an added feature of the invention, the drive elements comprise toothed belts having a plurality of preliminary leading-edge alignment markers attached thereto and spaced from one another a distance which is less than the distance of overlap of the imbricated sheets.

In accordance with yet an additional feature of the invention, the blowing-suction nozzles are rotatably mounted in the feed table for adjusting the pressure applied thereby to the sheets.

In accordance with yet a further feature of the invention, the suction rollers are arranged coaxially with rear reversing rollers for the drive elements.

In accordance with still another feature of the invention, there are provided sheet-guiding drive elements located in the alignment region and revolving in the conveying direction of the sheets, the drive elements having a speed which is at most equal to the stream feeding speed of the imbricated sheets, the preliminary leading-edge alignment markers being disposed in the drive elements, blowing suction nozzles disposed in the alignment region in the feed table for holding the sheets and for placing them, respectively, in engagement with the preliminary leading-edge alignment markers as well as a side marker rail, the acceleration device comprising conveying rollers for taking up the sheets and accelerating the conveying speed thereof to the peripheral speed of the impression cylinder, and the one conveying device following the diagonal drive comprising the first steadily rotating cylinder and carrying the front markers.

In accordance with still an added feature of the invention, the the diagonal drive comprises swivel-mounted suction rollers.

In accordance with still another feature of the invention, suction recesses are formed in part of the peripheral surface of the suction rollers, and the suction rollers have a speed forming an integral ratio with the cycle of the sheet-processing machine.

In accordance with still an additional feature of the invention, a preliminary leading-edge alignment marker is carried by the respective suction rollers.

In accordance with again another feature of the invention, a preliminary leading-edge alignment marker is carried by the respective conveying rollers of the acceleration device.

In accordance with again a further feature of the invention, there are provided synchronous rollers located above the feed table for cooperating with the suction rollers.

In accordance with again an added feature of the invention, there are provided synchronous rollers located above the feed table for cooperating with the conveying rollers of the acceleration device.

In accordance with again an additional feature of the invention, there is provided a lowerable sheet cover for the diagonal drive located on the feed table, the sheet cover having a plurality of members selected from ball and obliquely adjustable roller members.

In accordance with still another feature of the invention, the conveying speed of the stream-fed sheets is always slightly different from the speed of the diagonal drive, between the speed of the diagonal drive and the speed of the preliminary leading edge alignment marker and, respectively, between the preliminary leading-edge alignment marker and the front marker and between the acceleration device and the front marker.

In accordance with yet an additional feature of the invention, reversing rollers for the drive elements immediately follow the steadily rotating cylinder and are mounted via ball bearings on the suction rollers of the acceleration device.

In accordance with a concomitant feature of the invention, reversing rollers are provided for the drive elements, the reversing rollers being formed also as suction wheels.

A combination of the diagonal drive comprising a toothed belt drive for providing accurate guidance and blowing-suction nozzles for conveying the sheets on an air cushion ensures consistent and reliable positioning of the leading edges and side edges of the sheet. The suction effect of the blowing-suction nozzles permits reliable in-register positioning of sheets made of extremely thin paper. In the case of cardboard, the effect of the suction rollers can be intensified by the additional use of synchronous rollers.

Other features which are considered as characteristic for the invention are set forth in the appended claims.

Although the invention is illustrated and described herein as a method and device for aligning a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
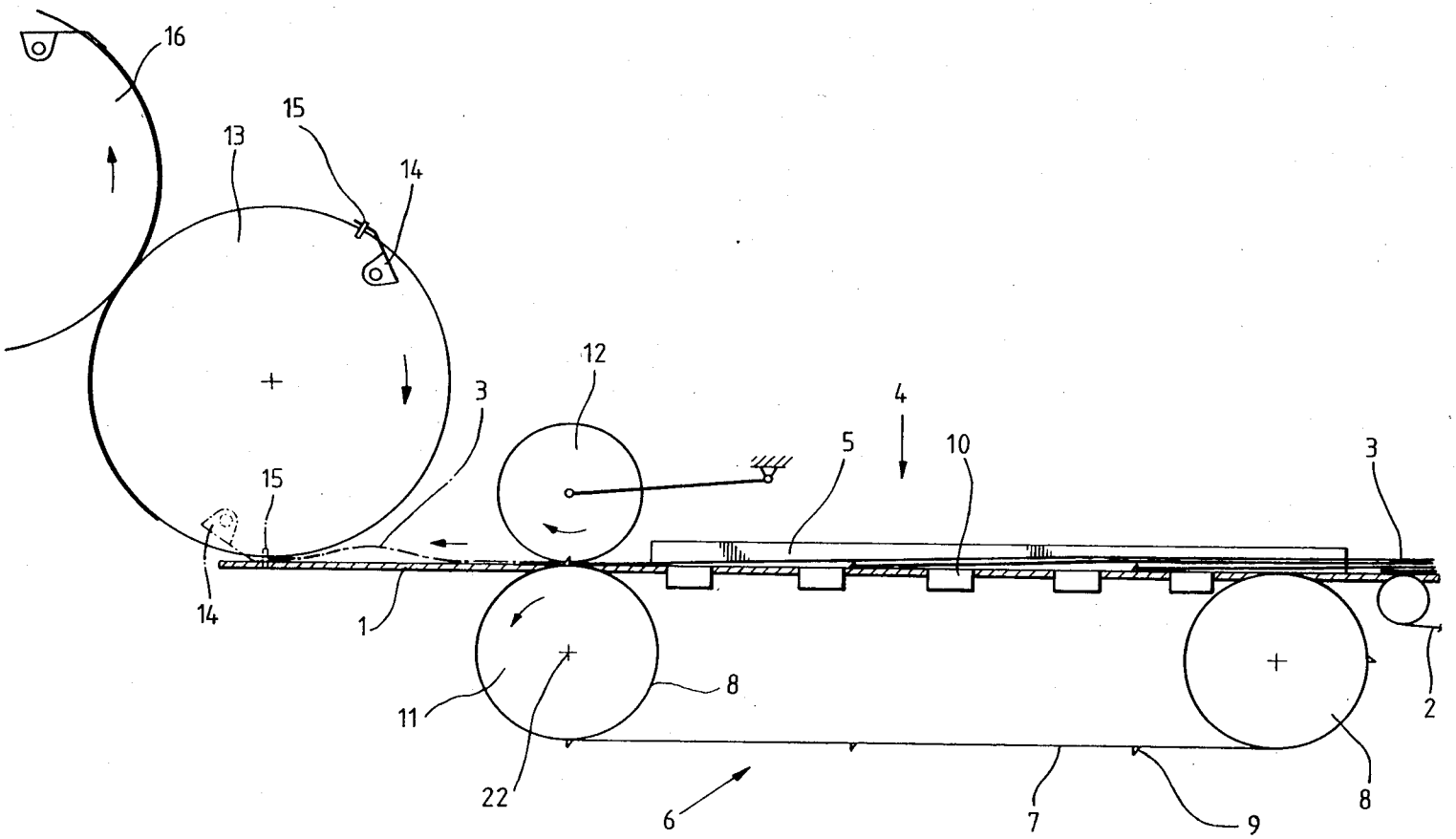
FIG. 1 is a diagrammatic elevational view of a first embodiment of a stream feeder incorporating the sheet alignment device according to the invention wherein sheets are aligned by means of a feeder drum.

Referring now to the drawing and, first, particularly to FIG. 1 thereof, there are shown conveyor belts 2 which are stream-fed in an overlapping or fishscale-like manner over a feeder table 1 to an alignment region 4 thereof. An adjustable side marker rail 5 is respectively provided at each side of this alignment region 4. Additional driving means, namely a toothed belt conveyor system 6, following the conveyor belts 2 is located below the feeder table 1 in the alignment region 4. The toothed belt conveyor system 6 is formed of several toothed belts 7 revolving in the conveying direction which extend over reversing rollers 8. At least two of these reversing rollers 8 are mounted beneath the feeder table 1. Several leading-edge preliminary alignment markers 9 are provided on the toothed belts 7. The spacing between the leading-edge preliminary alignment markers 9 is preferably smaller than the spacing between the overlapping stream-fed sheets. The spacing btween the markers 9 may also be equal to or greater than the spacing between the overlapping sheets, depending upon selected factors. Rotatable blowing-suction nozzles 10 are arranged in the alignment region 4 adjacent the toothed belts 7 in the feeder table 1 in such a manner that the main thrust direction of the blowing air current is selectively variable either towards the drive side or the operating side of the printing machine by suitably turning the blowing-suction nozzles 10. In a corresponding manner, adjustable conveying suction rollers can represent the diagonal drive instead of the blowing suction nozzles 10.

Suction rollers 11 acting as acceleration cylinders are advantageously provided beneath the feeding table 1 and are arranged coaxially to the rear reversing rollers 8. In the embodiment of FIG. 1, the diameter of the suction rollers 11 corresponds to that of the reversing rollers 8. The diameter of the suction rollers 11 may also deviate from that of the reversing rollers 8, however, when the rollers 8 and 11 are not arranged coaxially. The suction rollers 11 are formed with suction holes over part of the periphery thereof and, moreover, because the speed ratio thereof with the machine cycle is integral, they advance the sheet to be transported precisely in accordance with the machine cycle. It is also possible, however, to provide the entire periphery of the suction rollers 11 with suction holes and then make provision for a valve control system by means of which suction air is applied to the suction rollers 11. Above the suction rollers 11 i.e. above the feeder table 1, synchronous rollers 12 are pivotally mounted so as to be lowerable selectively onto the feeder table 1 in order to cooperate with the suction rollers 11. A feeder drum 13 is located at a lower or an inner end of the feeder table 1 and, insofar as it is of single-revolution operation, is provided with a row of grippers 14 and a row of front markers 15 associated therewith. On the other hand, if the feeder drum 13 is of half-revolution operation, it then, of course, has two gripper rows 14, two front marker rows 15 and a diameter double that of the suction rollers 11. The feeder drum 13 is followed by an impression cylinder 16.

To achieve absolutely reliable sheet guidance, in the alignment region 4 above the feeder table 1, a sheet cover not illustrated in FIG. 1 can be provided for the diagonal drive which is equipped with either diagonally or obliquely adjustable rollers or with balls.

The operation of the aforedescribed three-stage conveyor system is as follows:

In the first conveyor stage, rollers or the represented conveyor belts 2 transport the sheets 3 in an imbricated or fishscale-like overlapping arrangement in a direction towards the alignment region 4 of the feeder table 1. Thereat, the respectively foremost sheet 3 of the stream of overlapping sheets comes into contact with the leading-edge preliminary alignment markers 9 of the toothed or serrated belts 7. Because the toothed belt drive rotates at a speed which is slightly slower than the stream feed speed, the respectively foremost sheet 3 is brought into engagement with the leading-edge preliminary alignment markers 9 with forward thrust or propulsive force. The toothed belts 7 themselves are advantageously lowered so that they do not seize the sheet 3 being carried thereto on the surface of the feeder table 1.

The blowing-suction nozzles 10 provided in the feeder table 1 are set into action the instant a leading edge of the sheet 3 advanced by the overlapping stream of sheets has become engaged with the leading-edge preliminary alignment markers 9 of the toothed belts 7. The thrust of these blowing-suction nozzles 10 is set diagonally so that, on the one hand, the respectively more forward sheet of the overlapping stream becomes engaged with the leading-edge preliminary alignment markers 9 moving in the conveying direction and, on the other hand, however, it is also guided laterally against the side marker rail 5 adjusted respectively to the correct position. The correct position need not necessarily be parallel to the overlapping stream nor perpendicular to the leading edge of the sheet. On the contrary, a small angle of attack is advantageous, or instead thereof a local elevation or raised portion may be provided on the rail.

In addition to the thrust thereof, the blowing-suction nozzles 10 develop a given suction effect which causes the sheet 3 to be sucked down to the feeder table 1. If the toothed belts 7 were not arranged in a lowered position, the sheet 3 would also have been placed into engagement with the toothed belts 7 by the aforementioned suction effect. The thrust component of the blowing-suction nozzles 10 in the direction towards the side marker rail 5 would, however, itself then be strong enough to ensure the placement of the respective foremost sheet 3 of the stream against the side marker rail 5, if the sheet is to be disposed on the toothed belts 7. Especially worth mentioning is that the blowing-suction nozzles 10 disposed in the alignment region 4 produce a thin air cushion between the feeder table 1 and the underside of the sheet 3 of the imbricated or overlapping fishscale-like stream. This air cushion effects an exact alignment of the sheet 3 in spite of a continuous streaming transport or conveyance in the direction towards the printing unit.

The respectively foremost sheet 3 of the overlapping stream of sheets is thus flawlessly aligned preliminarily with regard to the side position and the leading-edge position thereof during the movement thereof over the feeder table 1 in the alignment region 4.

Finally, the edge of the leading sheet 3 of the imbricated stream reaches the vicinity of the rear reversing roller 8 of the toothed belt conveyor system 6. Because, as described hereinabove, suction rollers 11 are drivably mounted beneath the feeder table 1 coaxially with the rear reversing rollers 8, these suction rollers 11 then take over the farther transport of the sheet. They accelerate the respectively frictionally gripped sheet 3 in less than one revolution up to the peripheral speed of the impression cylinder. In addition, the synchronous rollers 12 can then also be used for this purpose if it is necessary to accelerate very heavy sheets or cardboard to the peripheral speed of the impression cylinder in a brief period of time. The thus accelerated sheet 3 is positioned with the leading edge thereof against the row of front markers 15 of the feeder cylinder 13 and finally aligned thereat. The sheet 3 assumes somewhat the arched position thereof shown in phantom in FIG. 1. After the alignment operation is completed, the grippers 14 close. The feeder drum 13 then transports the sheet 3 at the peripheral speed of the impression cylinder 16 and guides it to the impression cylinder 16.

Assuming that the peripheral speed of the toothed belt drive is 25% of the peripheral speed of the impression cylinder, the suction cylinders 11, if necessary or desirable, in cooperation with the synchronous rollers 12, need not accelerate the prealigned sheet from 0 to 100%. For this reason, a feed rate can be achieved with the described alignment and conveying system which is considerably higher than presently conventional values. The aforedescribed three-stage sheet stream-feed system for all types of paper and cardboard permits alignment at high printing speed, yet at limited expense. The alignment equipment per se is simple and requires little space. In order to increase further the accuracy of the preliminary leading-edge alignment, the suction rollers 11 themselves can be provided with preliminary leading-edge alignment markers 9. While the preliminary leading-edge alignment markers 9 arranged on the toothed belts 7 can have slight or low tolerances due to the flexibility of the toothed belts 7, the preferably single-turn rotating front marker on the suction roller 11 per se would be precisely positioned and could therefore be used for final leading-edge alignment.

An important prerequisite for flawless functioning of the three stage sheet conveying system in the feeder is that there must be at least a slight speed difference for each transition from one conveying system to the next. Consequently, a speed difference is assumed between the imbricated stream feed and the diagonal drive, between the diagonal drive and the preliminary leading-edge alignment marker, as well as, respectively, between the preliminary leading edge alignment marker and the front marker, on the one hand, and between the acceleration device and the front marker, on the other hand.

Figure 2:
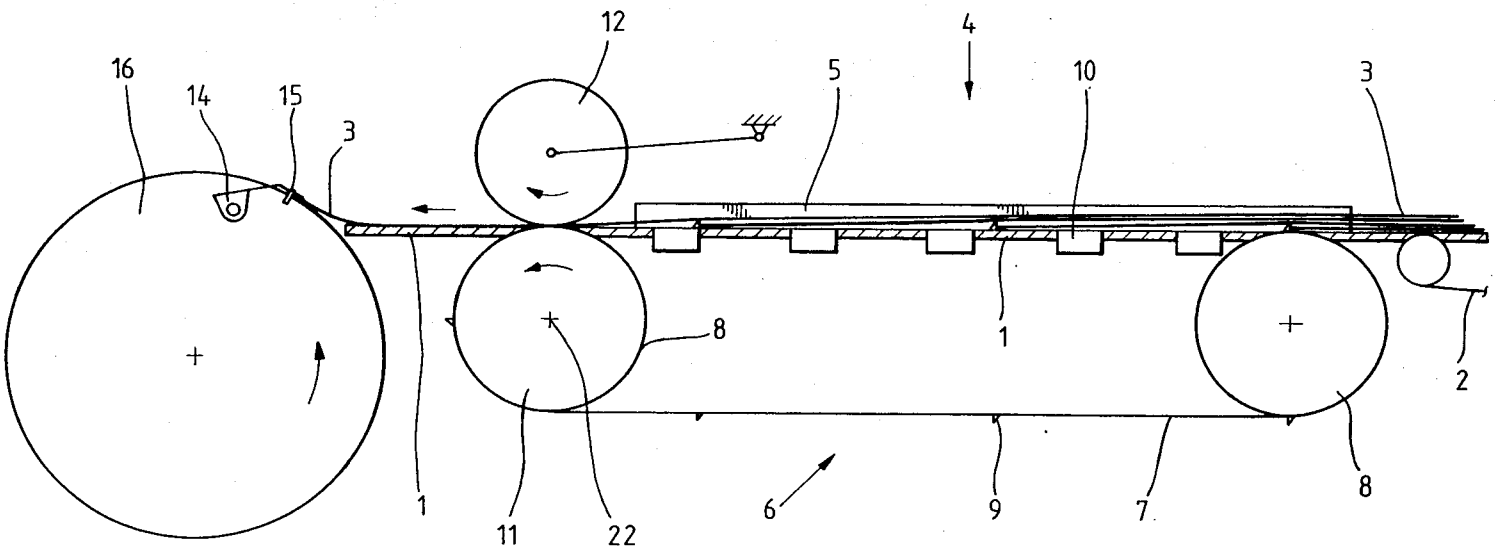
FIG. 2 is a view similar to that of FIG. 1 of a second embodiment of the invention wherein final alignment of a preliminarily aligned sheet is effected with the aid of front markers in the impression cylinder.

FIG. 2 shows a particularly simple embodiment of the invention. The sheets 3 are fed directly to the impression cylinder from the feed table 1. The entire alignment zone 4 of the device for aligning sheets as they are conveyed in stream-fed manner is formed precisely in the same way as for the embodiment according to FIG. 1. Only the feed table 1 is extended or lengthened beyond the suction rollers 11. The leading edge of the sheet 3 is raised in an arch directly in front of the surface of the impression cylinder 16 so that it extends almost tangentially to the jacket or outer surface of the impression cylinder 16. The leading edge of the sheet accelerated by the suction rollers 11 is brought into engagement with a row of front markers 15 which are arranged in front of the cylinder channel of the impression cylinder 16. Due to the slightly higher speed of the sheet as the result of the drive of the suction rollers 11, the leading region of the sheet firmly clings to the jacket surface of the impression cylinder 16. Final alignment of the sheets with regard to the position of the leading edge thereof occurs at this point. After this alignment process, the grippers 14 are closed and the sheet 3 is removed from the feed table 1 at the speed of the impression cylinder 16.

Figure 3:
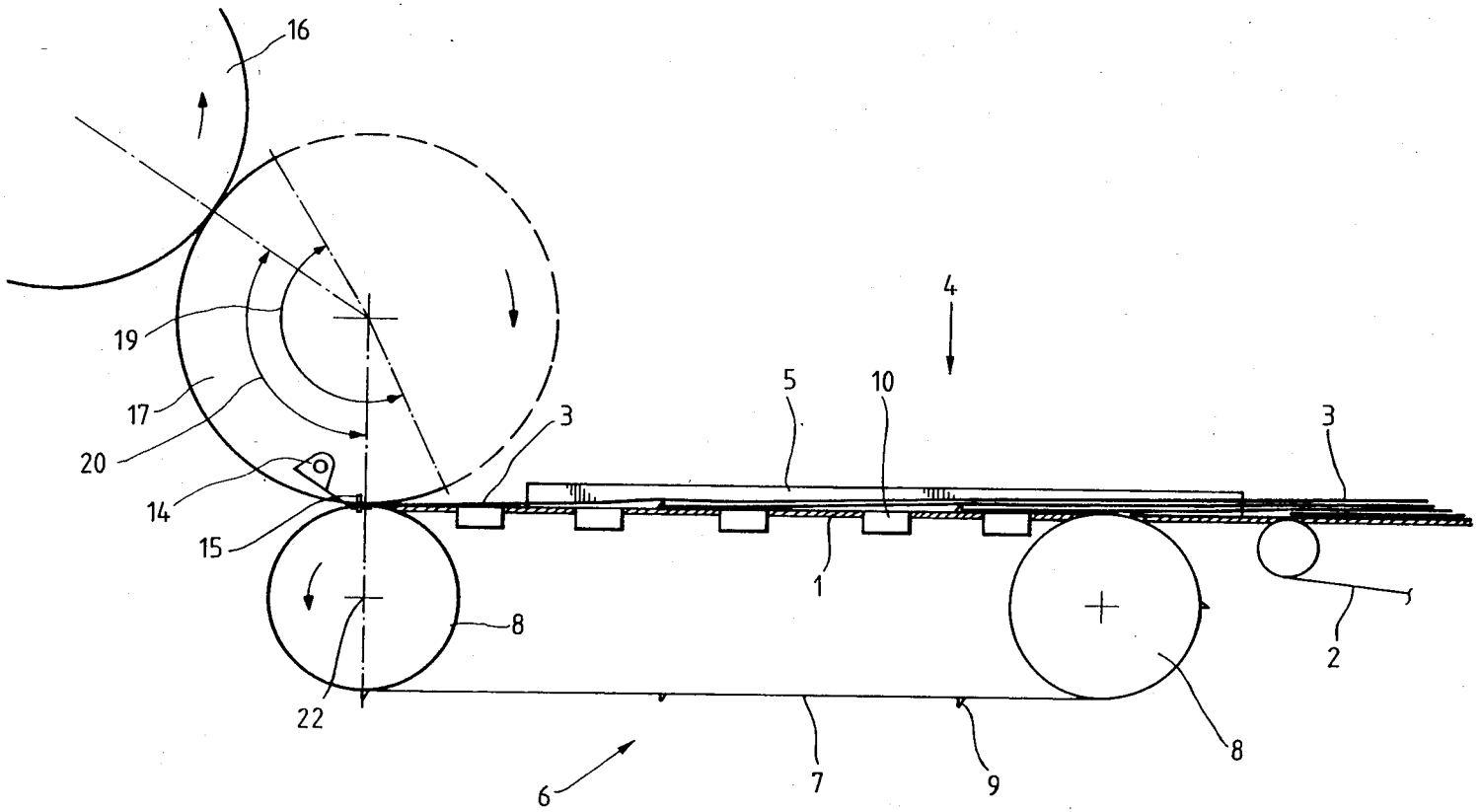
FIG. 3 is a view similar to those of FIGS. 1 and 2 of a third embodiment of the invention wherein final alignment of a preliminarily aligned sheet is effected with the aid of front markers on the pregripper.

The feeder according to FIG. 3 for aligning sheets as they are stream conveyed has, in the alignment region 4, practically the same arrangement as the two previously described embodiments, the only difference being that the synchronous rollers 12 are not included in this arrangement. Instead, an auxiliary gripper 17 is arranged above the lower reversing rollers 8 of the toothed belt 7, which is equipped with front markers 15, the row of grippers 14 holding the leading-edge region of the sheet 3 after its final alignment. An auxiliary or preliminary gripper drum could also be used instead of the auxiliary or preliminary gripper 17. The front markers 15 are arranged on the auxiliary or preliminary gripper 17 in an axial direction in such a way that they do not collide with the preliminary leading-edge alignment markers 9 on the toothed belts. It is, of course, also possible to use chains as the driving element instead of the toothed belts 7.

The auxiliary or preliminary gripper 17 swivels over a pivot angle 19. The acceleration of the sheet from the stream speed to the peripheral speed of the impression cylinder occurs while the operating angle 20 is traversed. The auxiliary or preliminary gripper 17 and the auxiliary gripper drum, respectively, transfer the completely aligned sheet to the impression cylinder 16 at the speed of the impression cylinder.

Figure 4:
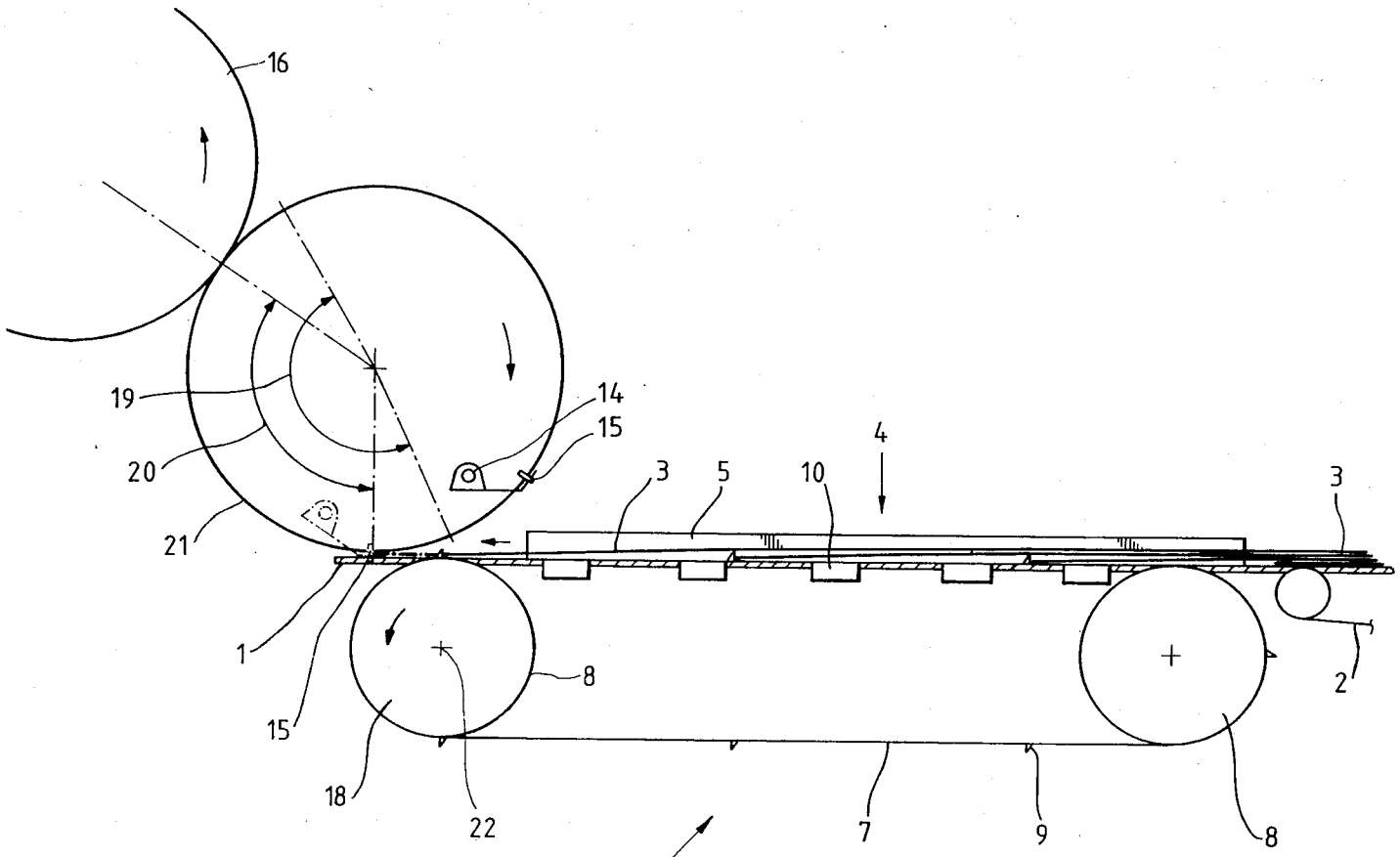
FIG. 4 is a view similar to that of FIG. 3 showing a fourth embodiment of the invention which is a modified form of the third embodiment wherein the pregripper is offset from the sheet conveyor in the conveying direction.

The embodiment of the invention shown in FIG. 4 differs from that described in accordance with FIG. 3 only in that the auxiliary or preliminary gripper drum is arranged slightly offset in the sheet conveying direction relative to the lower reversing rollers 8. The feed table 1 is therefore slightly extended or lengthened beyond the lower reversing rollers 8. Instead of the auxiliary or preliminary gripper drum 21, an auxiliary or preliminary gripper 17 can, of course, also be used as in the case of the previous embodiment which operates in accordance with the angles 19 and 20. The reason for the offset arrangement of the auxiliary or preliminary gripper drum 21 is that the toothed belts 7 can be arranged extremely close to one another over the width of the feed table 1 on the shaft 22 of the reversing rollers 8 without any construction difficulties arising with regard to accommodating the individual conveying elements on the shaft 22. In addition, no measures need to be taken in axial direction with regard to any potential collision of the preliminary leading-edge alignment markers of the toothed belts 7 with the front markers 15 of the auxiliary or preliminary gripper drum 21.

In addition to the reversing rollers 8, suction wheels 18 are arranged on the shaft 22 and have the same diameter as the reversing rollers 8 and consequently rotate at the same speed. These suction wheels 18 then further convey the sheet 3 carried by the blowing suction nozzles and prealigned by the preliminary leading-edge alignment markers in conjunction with the respectively set side marker 5 at stream speed until the leading edge of the sheet 3 engages the front markers 15 of the auxiliary or preliminary gripper drum 21 slowly moving into the alignment position, wherein it assumes its finally aligned position, and is grasped by the grippers 14 the instant the front markers 15 have reached the lowermost position thereof. After the grippers 14 have closed, the auxiliary or preliminary gripper drum 21 accelerates the held sheet within the operating angle 20 and transfers it at the end of the acceleration range to the impression cylinder 16 at the speed of the impression cylinder.

Figure 5:
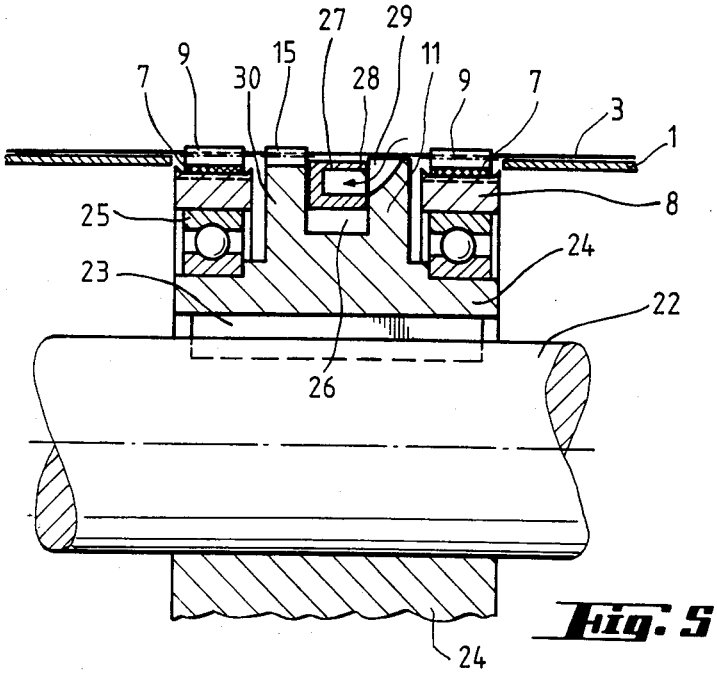
FIG. 5 is an enlarged fragmentary cross-sectional view of any of FIGS. 1 to 4 showing the arrangement and construction of reversing and suction rollers forming part of the inventive feeder.

FIG. 5 shows a possible embodiment of the suction roller 11 in conjunction with the reversing roller 8. This embodiment could be used on the shaft 22 of the two inventive feeders in accordance with FIGS. 1 and 2. The roller body 24 of the suction roller 11 is firmly keyed on the shaft 22 by mean of a feather key. In both of the ends thereof, reversing rollers 8 are mounted on ball bearings 25 so that they can turn freely. These rollers guide the toothed belts 7 to which the preliminary leading-edge alignment markers 9 are secured. This roller body 24 is formed with a groove 26 in the center thereof in which a suction tube 27 is arranged. This tube 27 has at least one lateral opening 28 which terminates in suction recesses 29 formed in the suction roller 11. By sucking the air from beneath the sheet 3 by means of the suction tube 27, the sheet 3 is held firmly against the suction roller 11, the suction air being applied only to the suction recess in the vicinity of the opening 28.

One side of the recess 26 is limited or bounded by a disc 30 of the roller body 24. A front marker 15 which can be used for final alignment of the sheet 3 advanced on the feed table 1, is arranged on the periphery of this disc 30. The marker 15 could also be used as a farther preliminary leading edge alignment marker.

Figure 6:
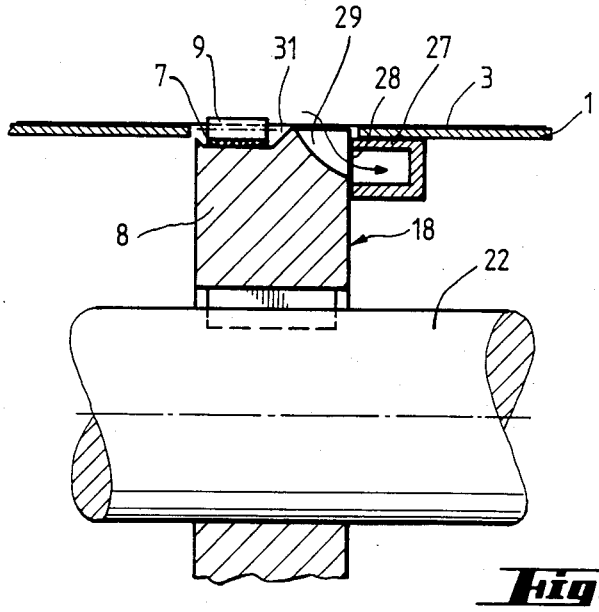
FIG. 6 is a view similar to that of FIG. 5 showing a reversing roller formed as a suction wheel.

FIG. 6 shows a special embodiment of a reversing roller 8, showing how it could be used on the shaft 22 in the embodiment according to FIG. 4. The reversing roller 8 is firmly keyed on the shaft 22. It is formed on the periphery thereof with a guide groove 31 for the toothed belt 7 which is equipped with preliminary leading-edge alignment markers 9. Next to the guide groove 31 suction recesses 29 are formed on the periphery of the reversing roller 8, and have suction air applied intermittently thereto via a suction tube 27 and its opening 28. The suction tube 27 is connected to a non-illustrated vacuum generator. Due to the suction effect, the sheet 3 conveyed via the feed table 1 is carried farther by the reversing roller 8 which is simultaneously constructed as a suction wheel 18, after being released by the downwardly dipping preliminary leading-edge alignment markers 9, until the sheet finally comes into engagement with the front marker 15 of the auxiliary or preliminary gripper drum 21 as shown in FIG. 4.

Figure 7:
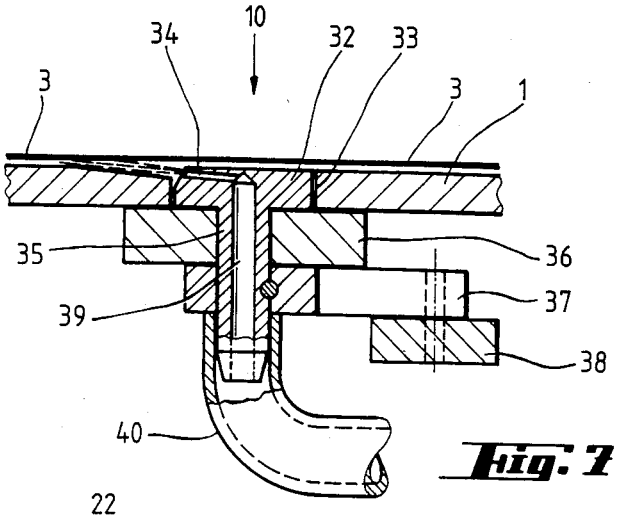
FIG. 7 is an enlarged fragmentary cross-sectional view of any of FIGS. 1 to 4 showing a blowing-suction nozzle.

The blowing suction nozzle 10 arranged in the alignment zone 4 of the feed table 1 can, for example, be arranged as shown in FIG. 7. In this embodiment, the blowing-suction nozzle 10 is basically formed of a nozzle disc 32 which is arranged so that it can rotate in a bore 33 formed in the feed table 1 and is approximately flush with the surface of the feed table 1. The nozzle disc 32 has one or more nozzles 34 which are aligned in such a way that air emerges therefrom almost parallel to the surface of the feed table 1. The air is blown under the sheet 3 and forms a thin air cushion there, between the outside of the sheet and the surface of the feed table 1. The nozzle disc 32 has a vertically downwardly extending pivot pin 35 which is mounted so that it can rotate in a bearing plate 36 and is firmly linked to a control lever 37. The free arm of the control lever 37 is linked to a control arm 38. A coaxial bore 39 extending through the pivot pin 35 connects its lower free end with the nozzles 34. A tube 40 is slid over this lower free end, thereby connecting a non-illustrated compressor with the nozzles 34 via the bore 39. The direction of thrust of the air emerging from the nozzles 34 can be varied according to requirements by turning the nozzle discs 32 in the bore 33 via the control arm 38 and the control lever 37.

Figure 8:
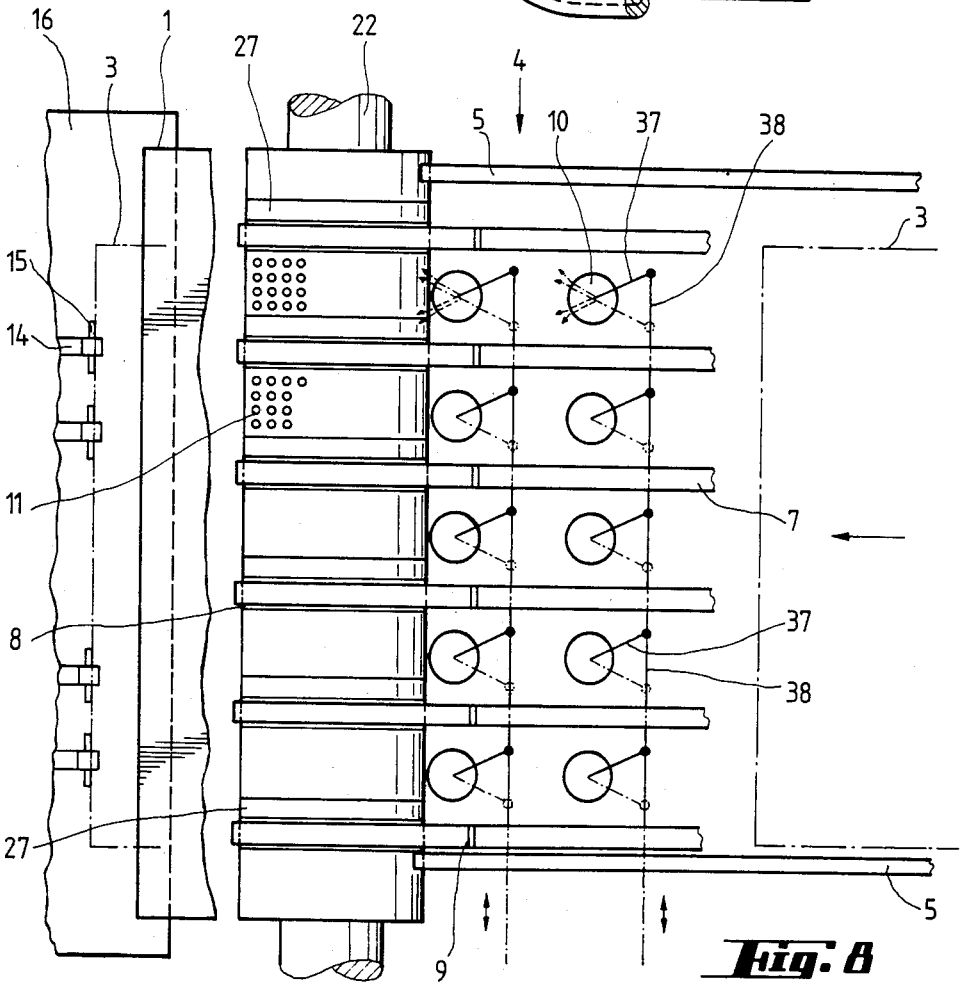
FIG. 8 is a diagrammatic top plan view of the sheet alignment device according to FIG. 2.

The manner of operation of the blowing-suction nozzles 10 of the embodiment of the invention according to FIG. 2 is shown in a top plan view in FIG. 8. In the interest of clarity, the synchronous roller 12 has been omitted. FIG. 8 shows the impression cylinder 16 in section with several of its grippers 14 and front markers 15. A sheet 3 is shown in phantom with its leading edge resting on the front markers 15. As shown in FIG. 2, the feed rable 1 extends almost up to the jacket or outer peripheral surface of the impression cylinder 16. The lower reversing rollers 8 for the toothed belts 7 and, next to them, the suction rollers 11 with the suction tubes 27 associated therewith are arranged on the shaft 22 beneath the feed table 1. Several rows of blowing-suction nozzles 10 are arranged one after the other between the toothed belts 7 which are provided with preliminary leading-edge alignment markers 9 as previously described hereinabove. The control lever 37 of each rotatable blowing-suction nozzle 10 is linked articulatingly with the control arm 38. The control arms 38 can be adjusted jointly or separately manually or by machine. An adjustable side marker rail 5 is located on the feed table 1 both on the control side and on the drive side. All of the blowing-suction nozzles 10 together form the diagonal drive. They can be set in such a way that the oncoming conveyed sheet 3 shown in phantom is directed either against the side marker rail on the control side or on the drive side during transport of the sheet in the alignment region 4 of the feed table 1. In the represented connection arrangement, the side marker rail 5 provided on the operating side is set with regard to its operative position. While the blowing-suction nozzles 10 alone provide the advancement of the sheets 3 in the alignment region 4, in this embodiment, the toothed belts 7 in conjunction with their preliminary leading-edge alignment markers 9 exclusively serve the purpose of guiding the sheet 3 as it is conveyed on this section. In this way, they provide the preliminary leading-edge alignment. The respectively set side marker rail ensures side edge alignment. The instant the suction rollers 11 can grasp the leading region of the sheet, the acceleration of the sheet 3 to a speed which is slightly greater than the peripheral speed of the impression cylinder is begun in order to ensure that the leading-edge of the sheet reliably rests against the front markers 15 of the impression cylinder 16.

The setting of the blowing-suction nozzles 10 can be varied in such a way that, in addition to the diagonal drive effect, smoothing of the leading region of the sheet can be achieved. This measure increases the accuracy of leading edge alignment of the sheet, thereby improving the register in multicolor printing.

The foregoing is a description corresponding in substance to German Application No. P 34 42 135.1, dated Nov. 17, 1984, the International priority of which is being claimed for the instant application, and which is hereby made part of this application. Any material discrepancies between the foregoing specification and the aforementioned corresponding German application are to be resolved in favor of the latter.

I claim:

1. Method of aligning sheets during stream feeding of a multiplicity of sheets over a feed table to a first steadily rotating cylinder of a sheet-processing machine, which comprises in a first feeding stage, conveying the sheets in an imbricated arrangement thereof via the feed table and in a given direction to an alignment region; in a second feeding stage, aligning a lateral and a leading edge of the sheets in the alignment region while the sheets remain in the imbricated arrangement thereof and without interrupting movement of the sheets in the given direction and, in a third feeding stage, accelerating the speed at which the sheets are stream fed to a peripheral speed of a rotating cylinder and feeding the sheets to the first steadily rotating cylinder, while finally aligning the sheets at front markers.

2. Method according to claim 1 which includes, in the first feeding stage, applying pressure through blowing-suction nozzles to the sheets so as to convey them, and guiding the sheets by drive elements with preliminary leading edge alignment markers holding the sheets in engagement with the side markers and the revolving preliminary leading-edge alignment markers due to the pressure from the blowing-suction suction nozzles, while the sheets are being conveyed; taking over the sheets by an acceleration device through frictional contact and accelerating the conveying speed of the sheets to the peripheral speed of an impression cylinder, and bringing the respective accelerated sheets into engagement with the front markers of a next following cylinder.

3. Device for aligning sheets as a multiplicity of the sheets are being stream fed over a feed table to a first steadily rotating cylinder of a sheet-processing machine, comprising a conveyor system disposed in an upper region of a feed table for conveying the sheets in an imbricated arrangement thereof and in a given direction to an alignment region; diagonal drive means disposed in said feed table downstream of said conveyor system in said given conveying direction and located at said alignment region for driving the sheets in a direction transverse to said given conveying direction, side markers disposed at opposite sides of said alignment region in said given conveying direction, and preliminary leading-edge alignment markers carried by said diagonal drive means and revolvable in said given conveying direction, said alignment region together with said diagonal drive means, said side markers and said preliminary leading-edge alignment markers being connected with said conveyor system on said feed table; an acceleration device cooperating with said diagonal drive means for accelerating the conveying speed of the sheets to a peripheral speed of an impression cylinder; and front markers disposed on at least one conveying device following said diagonal drive means.

4. Device according to claim 3 wherein said acceleration device comprises preliminary grippers to which said front markers are attached.

5. Device according to claim 3, wherein said diagonal drive means comprise sheet-guiding drive elements located in said alignment region and revolving in the conveying direction of the sheets, said drive elements having a speed which is at most equal to the stream feeding speed of the imbricated sheets, said preliminary leading-edge alignment markers being disposed on said drive elements, blowing suction nozzles disposed in said alignment region in the feed table for holding the sheets and for placing them, respectively, in engagement with said preliminary leading-edge alignment markers as well as a side marker rail, said acceleration device comprising conveying rollers for taking up the sheets and accelerating the conveying speed thereof to said peripheral speed of said impression cylinder, and said one conveying device following said diagonal drive means comprising said first steadily rotating cylinder and carrying said front markers.

6. Device according to claim 5 wherein a preliminary leading-edge alignment marker is carried by the respective conveying rollers of said acceleration device.

7. Device according to claim 5 including synchronous rollers located above the feed table for cooperating with said conveying rollers of said acceleration device.

8. Device according to claim 3 wherein said diagonal drive means comprise swivel-mounted suction rollers.

9. Device for alining sheets as a multiplicity of the sheets are being stream fed over a feed table to a first steadily rotating cylinder of a sheet-processing machine, comprising a conveyor system disposed in an upper region of a feed table for conveying the sheets in an imbricated arrangement thereof and in a given direction to an aligment region; diagonal drive means disposed in said feed table downstream of said conveyor system in said given conveying direction and located at said alignment region for driving the sheets in a direction transverse to said given conveying direction, side markers disposed at opposite sides of said alignment region in said given conveying direction, and preliminary leading-edge alignment markers carried by said diagonal drive means and revolvable in said given conveying direction, said alignment region together with said diagonal drive means, said side markers and said preliminary leading-edge alignment markers being connected with said conveyor system on said feed table; an acceleration device cooperating with said diagonal drive means for accelerating the conveying speed of the sheets to a peripheral speed of an impression cylinder; and front markers disposed on at least one conveying device following said diagonal drive means, said diagonal drive means comprising sheet-guiding drive elements located in said alignment region and revolving in the conveying direction of the sheets, said drive elements having a speed which is at most equal to the stream feeding speed of the imbricated sheets, said preliminary leading-edge alignment markers being disposed on said drive elements, blowing suction nozzles disposed in said alignment region in the feed table for holding the sheets and for placing them, respectively, in engagement with said preliminary leading-edge alignment markers as well as a side marker rail, said acceleration device comprising suction rollers for taking up the sheets and accelerating the conveying speed thereof to said peripheral speed of said impression cylinder, and said one conveying device following said diagonal drive means comprising said first steadily rotating cylinder and carrying said front markers.

10. Device according to claim 9 wherein said preliminary grippers, as viewed in conveying direction of the sheets, are arranged offset with respect to rear reversing rollers for said drive elements, and including conveyor rollers disposed coaxially with said rear reversing rollers and rotatable at the same speed thereof.

11. Device according to claim 10 wherein said conveyor rollers are in the form of suction wheels.

12. Device according to claim 7 wherein said drive elements comprise toothed belts having a plurality of said preliminary leading-edge alignment markers attached thereto and spaced from one another a distance which is less than the distance of overlap of the imbricated sheets.

13. Device according to claim 6 wherein said blowing-suction nozzles are rotatably mounted in said feed table for adjusting the pressure applied thereby to the sheets.

14. Device according to claim 9 wherein said suction rollers are arranged coaxially with rear reversing rollers for said drive elements.

15. Device according to claim 14 wherein suction recesses are formed in part of the peripheral surface of said suction rollers, and said suction rollers have a speed forming an integral ratio with the cycle of the sheet-processing machine.

16. Device according to claim 9 wherein a preliminary leading-edge alignment marker is carried by the respective suction rollers.

17. Device according to claim 9 including synchronous rollers located above the feed table for cooperating with said suction rollers.

18. Device according to claim 9 including a lowerable sheet cover for said diagonal drive means located on the feed table, said sheet cover having a plurality of members selected from ball and obliquely adjustable roller members.

19. Device according to claim 9 wherein the conveying speed of said stream-fed sheets is always slightly different from the speed of said diagonal drive means, between the speed of said diagonal drive means and the speed of said preliminary leading edge alignment marker and, respectively, between said preliminary leading-edge alignment marker and said front marker and between said acceleration device and said front marker.

20. Device according to claim 9 wherein reversing rollers for said drive elements immediately follow the steadily rotating cylinder and are mounted via ball bearings on said suction rollers of said acceleration device.

21. Device according to claim 9 wherein reversing rollers are provided for said drive elements, said reversing rollers being formed also as suction wheels.

* * * * *

UNITED STATES PATENT AND TRADEMARK OFFICE

CERTIFICATE OF CORRECTION

PATENT NO. : 4,696,465

DATED : September 29, 1987

INVENTOR(S) : Willi Jeschke

It is certified that error appears in the above-identified patent and that said Letters Patent are hereby corrected as shown below:

In the title page, item (75),
"Inventor: Jeschke Willi . . . "
should read:
"Inventor: Willi Jeschke . . . "

In the title page, below item (19),
"Willi"
should read:
"Jeschke"

Signed and Sealed this

Twenty-ninth Day of November, 1988

*Attest:*

*Attesting Officer*

DONALD J. QUIGG

*Commissioner of Patents and Trademarks*